US005772057A

United States Patent [19]

Finneran

[11] Patent Number: 5,772,057

[45] **Date of Patent: *Jun. 30, 1998**

[54] CRIMP TOP SEAL FOR VIALS

[75] Inventor: James G. Finneran, Vineland, N.J.

[73] Assignee: J.G. Finneran Associates, Inc., Vineland, N.J.

[ * ] Notice: The term of this patent shall not extend beyond the expiration date of Pat. No. 5,662,230.

[21] Appl. No.: 545,118

[22] Filed: Oct. 19, 1995

Related U.S. Application Data

[63] Continuation-in-part of Ser. No. 477,079, Jun. 7, 1995, Pat. No. 5,662,230, which is a continuation-in-part of Ser. No. 104,727, Aug. 11, 1993, abandoned, which is a continuation-in-part of Ser. No. 960,940, Oct. 14, 1992, abandoned, which is a continuation-in-part of Ser. No. 801,674, Dec. 2, 1991, abandoned, which is a continuation-in-part of Ser. No. 553,451, Jul. 13, 1990, abandoned.

[51] Int. Cl.[6] ..... B65D 41/34

[52] U.S. Cl. ..... 215/252; 215/321

[58] Field of Search ..... 215/321, 252, 215/253, 288, 286

[56] References Cited

U.S. PATENT DOCUMENTS

| | | |
|---|---|---|
| 1,661,977 | 3/1928 | Sutcliffe . |
| 1,862,620 | 6/1932 | Graham . |
| 2,109,805 | 3/1938 | Stewart . |
| 2,439,845 | 4/1948 | Swart . |
| 2,659,511 | 11/1953 | Rice . |
| 2,665,023 | 1/1954 | Migneault . |
| 3,227,303 | 1/1966 | Krakowsky . |
| 3,301,425 | 1/1967 | Brandtberg . |
| 3,480,172 | 11/1969 | Shine . |
| 3,833,142 | 9/1974 | Owen et al. . |
| 3,913,771 | 10/1975 | Acton et al. . |
| 3,966,082 | 6/1976 | Hopkins . |
| 4,037,746 | 7/1977 | Ver Hage . |
| 4,121,729 | 10/1978 | Husum . |
| 4,291,813 | 9/1981 | Allen et al. . |
| 4,303,167 | 12/1981 | Martinez . |
| 4,462,502 | 7/1984 | Luenser et al. . |
| 4,699,286 | 10/1987 | Nolan . |
| 4,923,072 | 5/1990 | Rilliet . |
| 5,085,332 | 2/1992 | Gettig et al. . |
| 5,088,612 | 2/1992 | Storar et al. . |

FOREIGN PATENT DOCUMENTS

| | | |
|---|---|---|
| 0 098 810 | 1/1984 | European Pat. Off. . |
| A-2705646 | 12/1994 | France . |
| 279495 | 10/1927 | United Kingdom . |
| 2073157 | 10/1981 | United Kingdom . |
| WO 95/04685 | 2/1995 | WIPO . |

OTHER PUBLICATIONS

European Search Report dated Oct. 16, 1996 corresponding to EP 96 10 9184.

Figure 1 –Standard Snap Cap Design.

Figure 2 –Standard Snap Cap Finishes.

Figure 3.

Figure 4 –Aluminum Seal Neck Finish.

Sun Brokers, Inc., Advertisement in LCGC Magazine, vol. 9, No. 7 (Jul. 7, 1991).

Helvoet Pharma USA (N.J.), Catalog pp. 4 & 5 (1990).

The West Co., Catalog entitled "West 800", pp. 7 and 18 (1991).

National Scientific Company, brochure entitled "National Scientific is Pleased to Announce a Merger" (1993).

*Primary Examiner*—Joseph M. Moy

*Attorney, Agent, or Firm*—Ratner & Prestia

[57] ABSTRACT

A crimp top seal which can be applied to a variety of different containers. Circumferentially displaced points or lines of contact between the crimp top seal and the container at axially displaced positions provide self-alignment and secure retention of the crimp top seal on the container. The resilient crimp top seal includes a top member, a skirt extending down from the perimeter of the top member, angular locking ribs, and a crimp ring—all of which engage the neck finish on the container. A plurality of reinforcing members are also provided on the inner surface of the skirt. The inner diameter of the skirt of the crimp top seal, the angle of the locking ribs, and the crimp ring provides the multiple, axially displaced lines of contact and allow the crimp top seal to engage a variety of containers.

10 Claims, 12 Drawing Sheets

CRIMP TOP SEAL FOR VIALS

This is a continuation in part of application Ser. No. 08/477,079, filed Jun. 7, 1995, now U.S. Pat. No. 5,662,230, which is a continuation-in-part of application Ser. No. 08/104,727, filed on Aug. 11, 1993 which, in turn, is a continuation in part of application Ser. No. 07/960,940, filed on Oct. 14, 1992 which, also in turn, is a continuation in part of application Ser. No. 07/801,674, filed on Dec. 2, 1991, which, still further in turn, is a continuation in part of application Ser. No. 07/553,451, filed on Jul. 13, 1990. The '727, '940, '674, and '451 applications have all been abandoned.

FIELD OF THE INVENTION

The invention relates to vials, particularly laboratory sample vials and dispensers for injectable pharmaceuticals and medicinal agents. Typically, this type of dispenser requires a securely sealed cap. The required seal is presently accomplished with a standard snap cap, a crimp aluminum cap, or a threaded cap and a corresponding bottle neck finish. In the present invention, the better properties of the snap cap and the crimp aluminum cap are adopted to provide a more safe and secure crimp top seal.

BACKGROUND

Many conventional containers have a standard snap cap and neck finish; most aspirin bottles utilize this type of container. In this basic snap cap design, the extended skirt of the cap secures under a protrusion on the neck of the vial such that there is one point of contact between the skirt and vial upon sealing the container. In addition, those designs which have more than one point of contact do not generally have tight dimensional tolerances between the cap and container contact points. This type of cap can only be used on vials which have a snap ring for engagement with the skirt of the snap cap.

The conventional design of the snap cap does not provide for ease of assembling the cap and the vial or for ease of removing the cap from the vial. The snap cap requires the use of downward pressure to apply the cap and upward pressure to remove the cap. Such pressure typically is exerted by the thumb of the user. Advantageously, a snap is heard or felt when the cap is positioned and the container is sealed. No tools are required either to apply or to remove the cap.

The cap and container are typically made of plastic. This is advantageous because metal is undesirable in laboratory settings. The seal is consistent and provides an adequate short term (about 8 hours) seal against solvent evaporation. Because the materials used to form the cap and container are not very rigid, however, the designs cannot provide a seal able to withstand contents under high pressure or provide for long term storage without leakage—even with multiple points of contact. The protrusion on the neck of conventional vials is of increased mass; therefore, dimensional tolerance is not closely controlled during the molding process. Furthermore, the basic snap cap design does not allow for self-aligning or secure retention of the cap and the vial.

Another common closure for containers of this type is a crimp cap, which is securely retained on the neck finish of the container by crimping a metallic (usually aluminum) skirt under a lip on the neck of the container. One advantage of the aluminum crimp cap is that it works on containers having either a standard crimp seal or a snap ring. A disadvantage is that the aluminum crimp cap requires the use of a crimping tool to form a seal. The seal is subject to the amount of squeeze and alignment given by the user. When properly applied, however, the aluminum crimp cap provides a good seal against solvent evaporation.

The crimping tool is made of metal (typically aluminum) to provide the force necessary to deform the aluminum crimp cap and, thereby, either to apply or remove the aluminum crimp cap to or from the container. Removal of an aluminum crimp cap from a container is dangerous. If not done properly, the neck finish of the container can break—leaving ragged glass edges. Moreover, sharp aluminum pieces are exposed as the aluminum crimp cap is literally torn away from the container.

Still another common closure for containers involves a standard screw thread neck finish on the vial and a corresponding screw thread on the cap. Closure is attained and a seal obtained by twisting or rotating the cap onto the vial. Thus, screw thread closures require finger torque pressure to apply and remove the cap. The seal is subject to the amount of torque applied by the user. When torqued properly, the threaded cap provides a good seal equivalent to or better than the aluminum crimp seal. One drawback is that the threaded cap can lose torque upon relaxation of the plastic material, from which the typical threaded cap is made, which allows the cap to back off the threads. In addition, the threaded cap can only be used on threaded vials.

Finally, conventional containers allow only one type of cap per container. Suppliers must maintain large inventories, therefore, of several types of caps and several types of corresponding containers. These containers also are not conducive to simple industrial automation; the only convenient means of handling the containers is with complicated and expensive equipment.

BRIEF DESCRIPTION OF THE INVENTION

In the present invention, there is provided a crimp top seal which can be applied to a variety of different containers. Circumferentially displaced points or lines of contact between the crimp top seal and the container at axially displaced positions provide self-alignment and secure retention of the crimp top seal on the container. The resilient crimp top seal includes a top member, a skirt extending down from the perimeter of the top member, angular locking ribs and a plurality of reinforcing members on the inner surface of the skirt, and a crimp ring or lugs—all of which engages the neck finish of the container. The inner diameter of the skirt of the crimp top seal, the angle of the locking ribs, and the crimp ring provide the multiple, axially displaced lines of contact and allow the crimp top seal to engage a variety of containers.

DETAILED DESCRIPTION OF THE INVENTION

Figure 1:
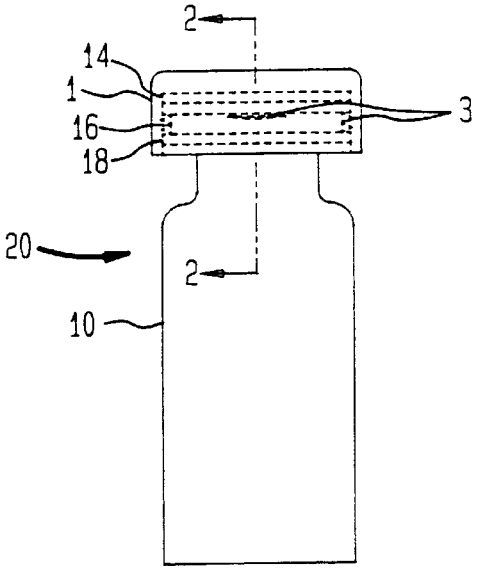
FIG. 1 illustrates a container and cap combination in accordance with the present invention.
Figure 2:
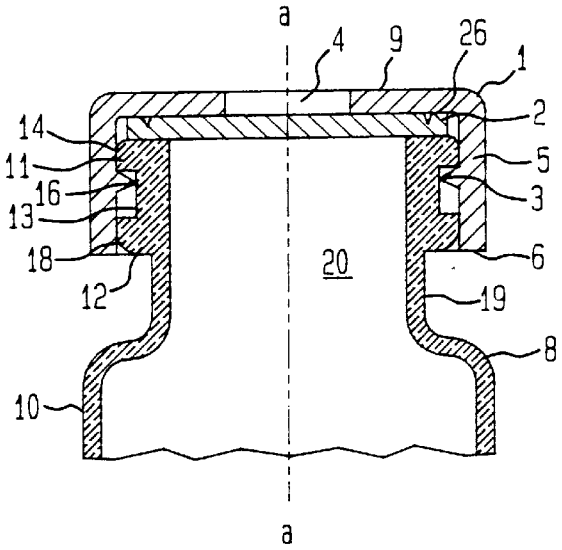
FIG. 2 is an expanded, cross-sectional view of the upper part of the cap-container combination shown in FIG. 1, taken along plane 2—2.

As shown in FIGS. 1 and 2, the present invention includes a container and cap combination 20, comprising container 10 and resilient cap 1 having an axis, a. Three lines of contact 14, 16, and 18 exist between cap 1 and container 10 which provide self-aligning and secure retention of cap 1 and container 10. Container 10 may be plastic, glass, or other similar material. Cap 1 is a resilient material such as plastic.

Figure 4:
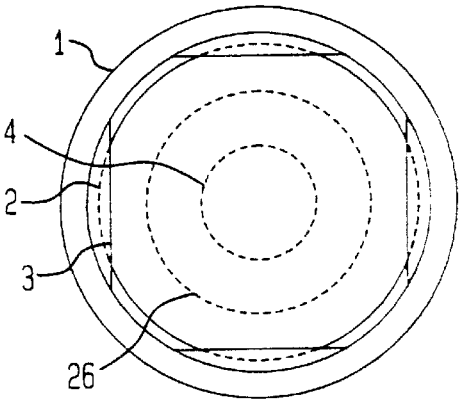
FIG. 4 is a top view of the inside of the cap of the combination shown in FIG. 1, taken along plane 4—4 of FIG. 3.
Figure 3:
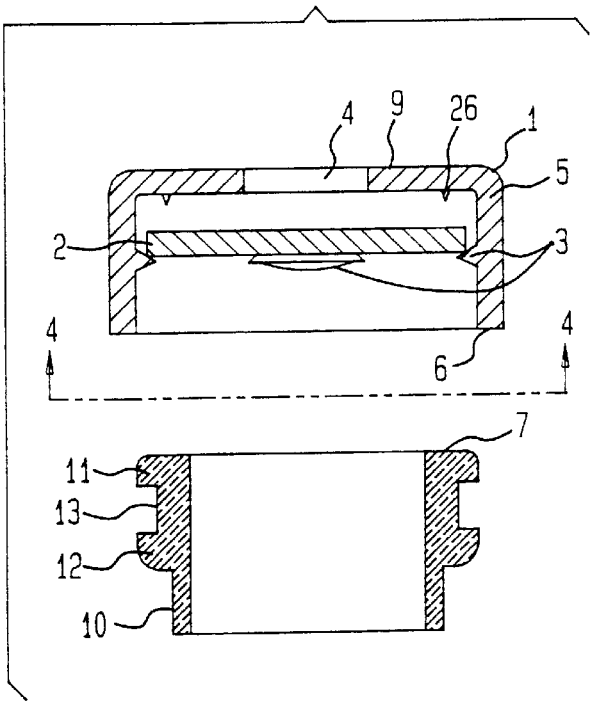
FIG. 3 is similar to FIG. 2 with the components dissembled.

Now referring to details of this cap-container combination as better seen in FIGS. 2–4, cap 1 includes top member 9 with a center opening 4. Cap 1 has the capacity to retain within itself liner 2 which may be composed of silicone rubber, butyl rubber, natural rubber or the like. Thus, liner 2 is resilient and underlies top member 9. It is possible to access the contents of container 10 without removal of cap 1 by, for example, inserting a syringe into center opening 4 and through perforatable liner 2. Center opening 4 is sufficiently wide (on the order of 5–6 millimeters) to allow a syringe to be inserted without bending or breaking.

Historically, heavy metals such as cadmium have been used to manufacture liner 2, especially when container and cap combination 20 were designated for certain applications. The industry has moved toward stricter regulations, however, requiring proper disposal of such heavy metals. Compliance with these regulations is made easier by manufacturing liner 2 without heavy metals.

Cap skirt 5, the internal diameter of which corresponds to or is only slightly greater than the outer diameter of the neck of container 10, extends vertically (axially) downward from cap top member 9 to cap lower end 6, to be substantially flush laterally with the bottom of the lower flange 12 of container 10, and facilitates alignment of cap 1 and container 10 as they are assembled. Four angular locking ribs 3 project from skirt 5 and are located at circumferentially spaced locations around the inside of skirt 5 along contact line 16. Locking ribs 3 are placed at an axially intermediate height inside skirt 5 to provide, in combination with contact lines 14 and 18, alignment between cap 1 and container 10. The angular shape of locking ribs 3 also allows for tolerance variation of liner 2, ±0.010 of an inch, thus accommodating thick and thin liners. Locking ribs 3, as shown in FIG. 4, retain liner 2 and provide the pull down and lock mechanism which seals container 10.

Circular ridge 26 extends from the underside of top member 9 of cap 1 and aligns with the neck of container 10. Circular ridge 26 applies a slight pressure to liner 2 urging liner 2 outward, thus more securely sealing container 10.

To facilitate alignment, as well as retention of cap 1 on container 10, the neck finish of container 10 includes upper flange 11 and lower flange 12, between which is disposed snap groove 13. When cap 1 is mounted on container 10 and force is applied to top member 9, locking ribs 3 expand past upper flange 11 and engage snap groove 13. Thus, snap groove 13 provides the pull down and lock mechanism in conjunction with locking ribs 3 which seals container 10.

Ridge 26 also acts, as a fulcrum, when ribs 3 are locked in snap groove 13 between upper flange and lower flange, 11 and 12, pulling downward on cap skirt 5.

There are three lines of contact 14, 16, and 18 between skirt 5 of cap 1 and the neck finish of container 10. Locking ribs 3 engage snap groove 13 thus defining line of contact 16, formed between the apex of each rib 3 and the inner surface of groove 13, and the enlarged inner diameter of skirt 5 above and below ribs 3 contacts flanges 11 and 12, thus defining lines of contact 14 and 18. (Although the top angled surface of each rib 3 may engage under flange 11, depending on the dimensions of the various components and, specifically, of the liner 2, such engagement is viewed as a continuation of contact line 14 and not as a discrete line of contact.) The three lines of contact self-align and securely retain cap 1 and container 10.

The snap groove 13 has a substantially rectangular cross-section (rectangular with some latitude allowed for tolerance variation), formed between the top flange 11 and the lower flange 12, to accept locking ribs 3 while allowing tolerance variation upon downward movement of cap 1 onto container 10. Also, the snap groove 13 between flanges 11 and 12 causes the neck finish of container 10 to be of reduced mass as compared to conventional neck finishes for receiving a self-gripping cap. This facilitates tighter dimensional tolerance in the molding of the neck finish (yet permits mating with the self-aligning cap of the present invention and permits better gripping as well) because thermal expansion and contraction is controlled in the molding of the glass or plastic article. Therefore, closer dimensional tolerance is permitted as compared to conventional containers.

More important, the multiple axially displaced alignment features of the mating cap and neck finish of the present invention provide a self alignment, which in turn results in better, i.e. more secure, cap retention, as well as more secure seating and sealing of liner 2 between the mating opposing surfaces of cap 1 and the top of the neck finish of container 10. To best accomplish this, the dimensional tolerances of the opposing surfaces of the inner diameters of skirt 5 and the outer diameters of the container neck flanges 11, 12 and groove 13 are all tightly controlled, preferably to plus or minus 5–10 thousandths of an inch, most preferably 3–7 thousandths of an inch.

Figure 5:
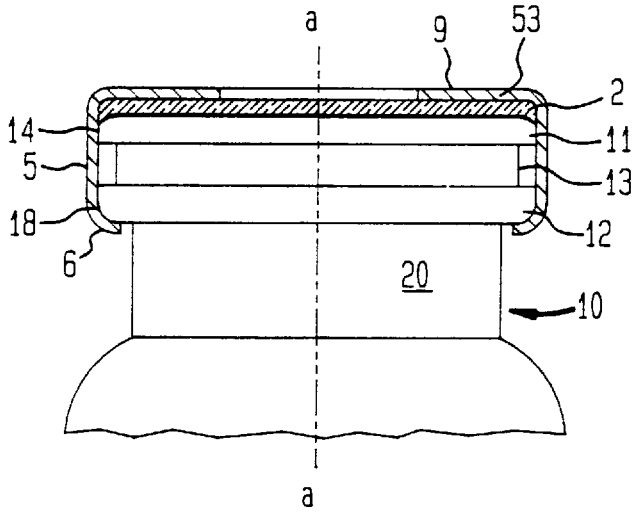
FIG. 5 is an expanded cross-sectional view of the upper part of the container of the present invention with the alternative crimp cap for which it is adapted.
Figure 6:
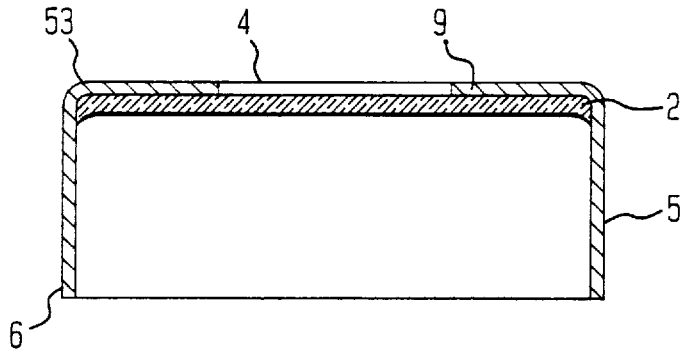
FIG. 6 is an expanded cross-sectional view of the crimp cap prior to assembly.

A cap with a crimp seal 53, as shown in FIG. 6, composed of aluminum, for example, may also be used to seal container 10 by securing the lower end 6 of skirt 5, as shown in FIG. 5, under lower flange 12 of container 10. The skirt 5 of the crimp seal 53 provides two points of contact, 14 and 18, between the skirt 5 and the upper flange 11 and the lower flange 12 of the container 10 in addition to the point of contact between the lower end 6 of the crimp cap skirt 5 and the bottom of lower flange 12.

Thus, the container of the present invention allows the user a choice of capping, cap 1 or a crimp seal 53, thus minimizing the container inventory required.

Figure 7:
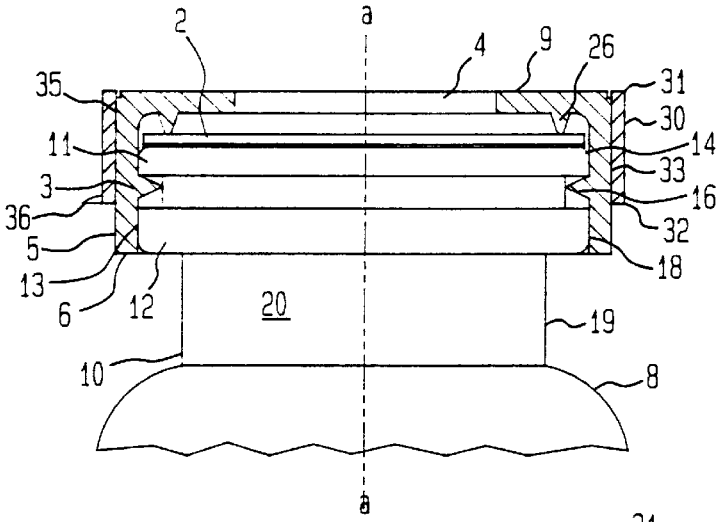
FIG. 7 is an expanded cross-sectional view of the cap-container combination with collar in accordance with the present invention.
Figure 8:
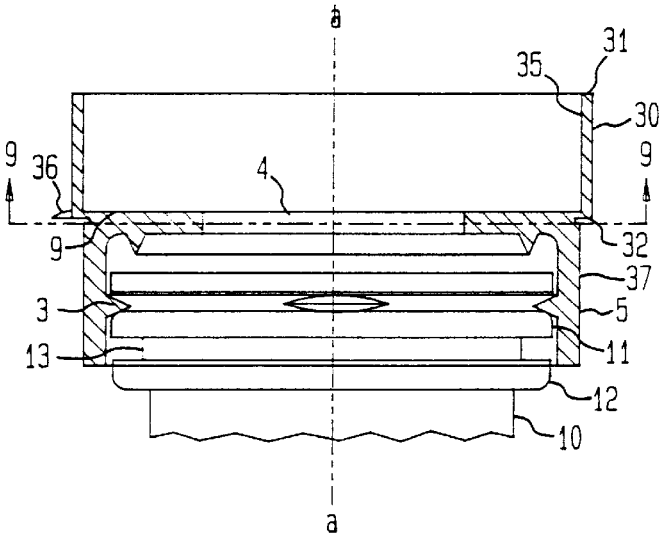
FIG. 8 is an expanded cross-sectional view of the one piece cap with optional collar placed on the container just before assembly therewith to effect sealing of the container.
Figure 9:
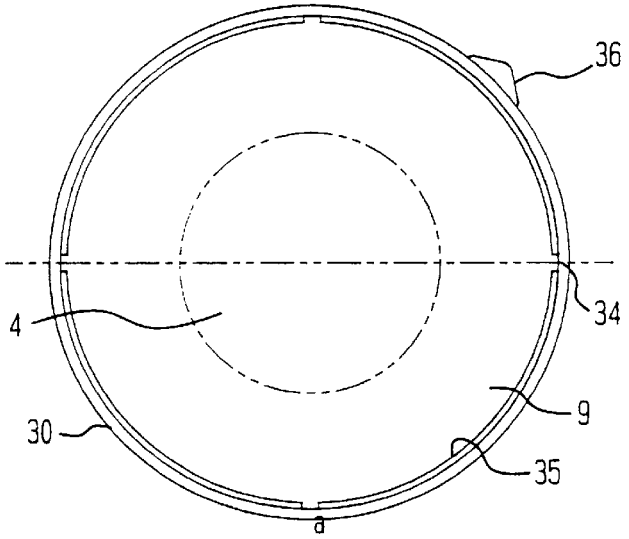
FIG. 9 is bottom view of the one piece cap with collar taken along the plane 9—9 of FIG. 8.
Figure 10:
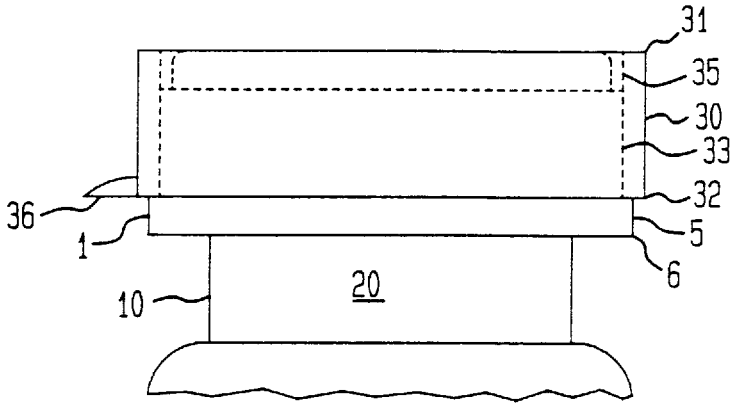
FIG. 10 is a side view of a cap-container combination with collar in accordance with the present invention.
Figure 11:
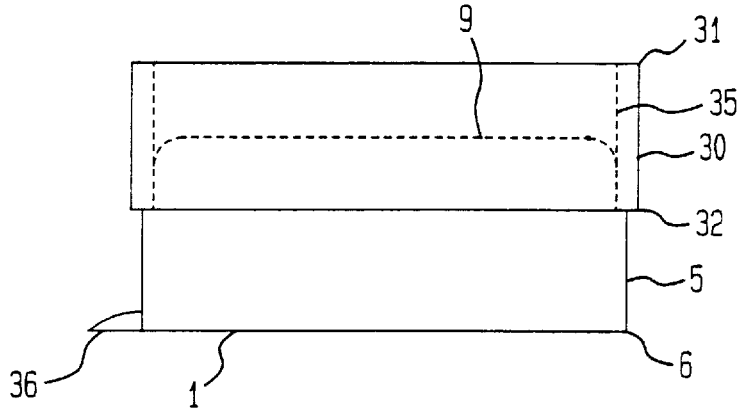
FIG. 11 is an expanded view of a cap with a collar partially slid over the cap.
Figure 12:
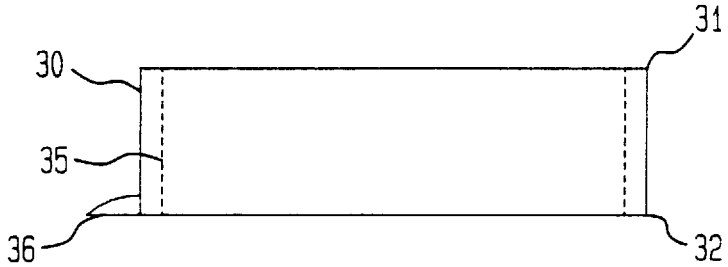
FIG. 12 is an expanded view of a separate collar.

FIGS. 7–12 show the use of a collar 30 in conjunction with a cap 1, where FIGS. 7–9 show a one-piece cap with collar 37 and FIGS. 10–12 show the use of a separate collar 30 or the use of the collar 30 shown in FIGS. 7–9 once detached from the cap 1.

FIG. 7 is a detailed view of the configuration of the container 10, cap 1, and collar 30 in combination. As shown in FIG. 7, the use of the collar creates an area of continuous contact 33 around the entire circumference of the cap 1, from the upper edge 31 of the collar 30 to the lower edge 32 of the collar 30. The continuous contact 33 provides radial pressure against the cap 1 and from the cap 1 against the container 10 since the inner diameter 35 of the collar 30 is slightly smaller than, but in tight tolerance with, the outer diameter of the cap 1.

In detail, the continuous contact 33 enhances the perpendicular pressure, relative to axis a, of the three points of contact, 14, 16, and 18, between the cap 1 and the container 10. The additional pressure against the points of contact increases the ability of the container-cap combination 20 to withstand high internal pressure and improves sealability for long term storage.

FIG. 7 shows the upper edge 31 of the collar 30 flush with the top member 9 of the cap 1 and the lower edge 32 of the collar 30 even with the bottom of the angular locking ribs 3 on the inner diameter of the cap 1. The upper edge 31 of the collar 30 could be placed in a range of positions along the cap, from the top of the angular locking ribs 3 on the inner diameter of the cap 1 to the top member 9 of the cap 1, and the lower edge 32 of the collar 30 could be placed in a range of positions along the cap, from the bottom of the angular locking ribs 3 on the inner diameter of the cap 1 to the lower end 6 of the cap 1, while still providing increased perpendicular pressure to the three contact points between the cap 1 and the container 10—although the amount of pressure could vary as a function of the choice of positions chosen for the lower and upper edge of the collar, 31 and 32.

On the lower edge 32 of the collar 30 there can be a tab 36. The tab 36 is used to allow pulling on (for easy assembly) or pushing off (for easy removal) of either the cap 1 and collar 30 at one time or just the collar 30 by a user or automated equipment.

FIGS. 8 and 9 illustrate an exemplary form of a one-piece cap with collar 37. FIG. 8 shows the one-piece cap with collar 37 placed on the container 10 in preparation for sealing the container 10 by snapping the cap 1 over the container 10. FIG. 9 shows an exemplary method of detachably securing the collar 30 to the cap 1. The collar 30 in FIG. 9 is attached to the cap 1 by tabs 34. The collar 30 could also be attached to the cap 1 by a continuous membrane, or a continuous membrane with a thin score line.

The securing means described above allows the user or automated equipment, by placing downward axial pressure on the entire upper edge 31 of the collar 30, to: snap the cap 1 onto the container 10, separate the collar 30 from the cap 1, and slide the collar 30 into position alongside the cap 1 with only one, single, downward action. This allows the cap 1 and collar 30 to seal the container 10 with only one operation. The one-piece cap with collar 37 is formed in a single molding operation and, thus, is of the same material.

FIGS. 10–12 show an exemplary use of a separate collar 30, or a collar 30 as shown in FIGS. 7–9 once detached from the cap 1, to enhance the points of contact between the cap 1 and the container 10. FIG. 10 shows the collar 30 in place over the cap 1 and is similar to FIG. 7. FIG. 11 shows a version of the cap and a separately formed collar, or a collar 30 as shown in FIGS. 7–9 once detached from the cap 1, where the combination is preassembled. FIG. 12 shows an exemplary, separately formed collar 30 or a collar 30 as shown in FIGS. 7–9 once detached from the cap 1.

There are additional advantages to the use of a separately formed collar in conjunction with the cap and container combination 20 described above. The separately formed collar 30 can be formed of more rigid material than the cap 1, thereby increasing the radial pressure when the collar 30 is in position, thus further enhancing the sealability of the container 10 and the long-term storage potential. The separately formed collar 30 may also be a pre-selected color for container content identification purposes.

Preferably, the cap and container combination 20, with or without a collar 30, should have a maximum vertical clearance between lower end 6 of cap 1 and shoulder 8 of container 10 of at least ⅛–3⁄16 of an inch to allow a point of contact 19, as seen in FIG. 2, for positioning container 10, either manually or by automated equipment (such as robotically).

Turning to FIGS. 13A–15B, the cap-container combination 20 is illustrated with a pull tab 60. The reason for providing pull tab 60 is as follows.

To provide an adequate seal between cap 1 and container 10, especially when highly volatile solvents will be stored, a solvent-resistant material such as polypropylene must be used to form cap 1. Container 10 is formed of glass, plastic, or the like—as described above. The cap-container combination 20 is assembled by aligning cap 1 with the top surface 7 of container 10 (see FIG. 3) and applying downward pressure on cap 1. Such downward pressure enables locking ribs 3 to expand past upper flange 11 and to engage snap groove 13. With locking ribs 3 engaging snap groove 13, liner 2 seals against top surface 7 of container 10. The user can accomplish such assembly of the cap-container combination 20 with relative ease using, for example, the thumb. Automated equipment could also be used to assemble the cap-container combination 20.

The seal formed between cap 1 and container 10 often is so good, however, that a problem arises: removal of cap 1 from container 10 is difficult. The user may be unable to push upward (using, for example, the thumb) on the cap lower end 6 with sufficient force to disengage locking ribs 3 from snap groove 13. Consequently, an external tool, such as a bottle opener, pliers, or the like, may be required to generate the force required. Of course, automated equipment would overcome the removal problem created by the excellent seal.

To facilitate removal of cap 1 from container 10 by the user, a pull tab 60 is provided. Pull tab 60 may be molded integrally with cap 1. If so, the preferable molding position of pull tab 60 relative to cap 1 is shown by the dashed lines in FIG. 13C. Thus, pull tab 60 may be of the same material as cap 1.

Figure 13A:
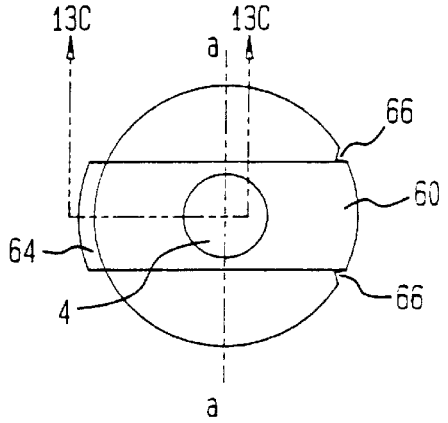
FIG. 13A is a top view of a cap without a collar but with a pull tab.
Figure 13B:
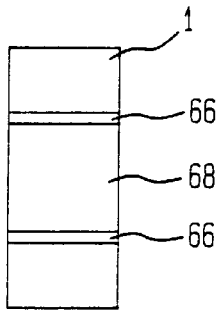
FIG. 13B is a side view the cap shown in FIG. 13A.
Figure 13C:
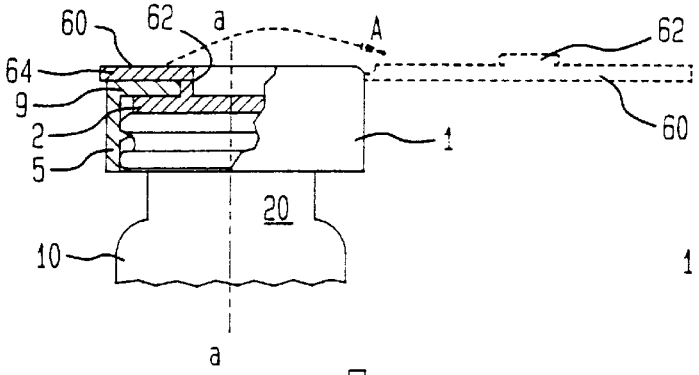
FIG. 13C is side view, in partial cross-section, of a cap-container combination with a cap pull tab in accordance with the present invention, taken along plane 13C—13C of FIG. 13A.
Figure 14A:
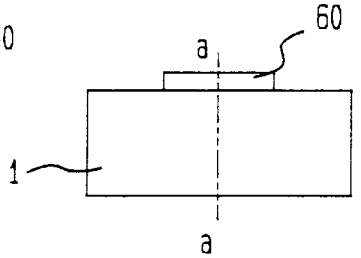
FIG. 14A is a side view of a cap with a pull tab in the closed position.

Pull tab 60 has a central locking ring 62. When pull tab 60 is in its closed position, as shown in FIGS. 13A, 13C, and 14A, locking ring 62 frictionally fits within opening 4 in cap 1. The friction fit between locking ring 62 and opening 4 holds pull tab 60 in place over cap-container combination 20.

Pull tab 60 has an outer rim 64 which extends laterally beyond top member 9 of cap 1. The user can easily push upward on outer rim 64 (using, for example, the thumb) to remove locking ring 62 from opening 4. Such action will displace pull tab 60 along the path of arrow "A" in FIG. 13C, from its closed position (shown in solid lines) to an open position (shown in dashed lines).

Figure 14B:
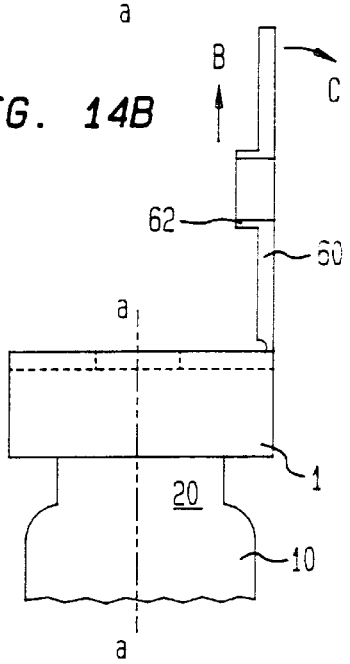
FIG. 14B is a side view of a cap-container combination with a pull tab in the open position.
Figure 14C:
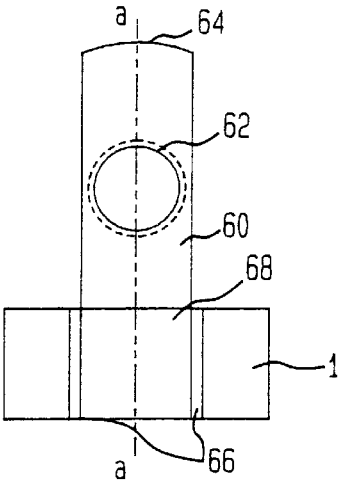
FIG. 14C is a front view of a cap with a pull tab in the open position.

Once locking ring 62 disengages opening 4, and preferably when pull tab 60 is in a completely vertical position parallel to axis a (as shown in FIGS. 14B and 14C), the user can pull upward on pull tab 60 in the direction of arrow "B" in FIG. 14B. Pull tab 60 allows the user to generate more upward force than was possible without pull tab 60. Consequently, the user can displace locking ribs 3 from snap groove 13, thereby disengaging cap 1 from container 10, without the need for external tools.

For many applications, cap 1 is removed from container 10 only once; cap 1 is not required to re-seal container 10 after container 10 is first opened. Especially for such applications, cap 1 may be provided with one or more tear grooves 66 defining a tear ring 68. Tear ring 68 may be integrally formed with pull tab 60. Once locking ring 62 disengages opening 4, and preferably when pull tab 60 is in a completely vertical position parallel to axis a (as shown in FIGS. 14B and 14C), the user can pull downward on pull tab 60 in the direction of arrow "C" in FIG. 14B. The downward force on pull tab 60 breaks tear ring 68 along tear grooves 66 (which are weaker than the remainder of cap 1). Because cap 1 then has a gap where tear ring 68 has been removed, cap 1 can easily be removed from container 10.

Figure 15A:
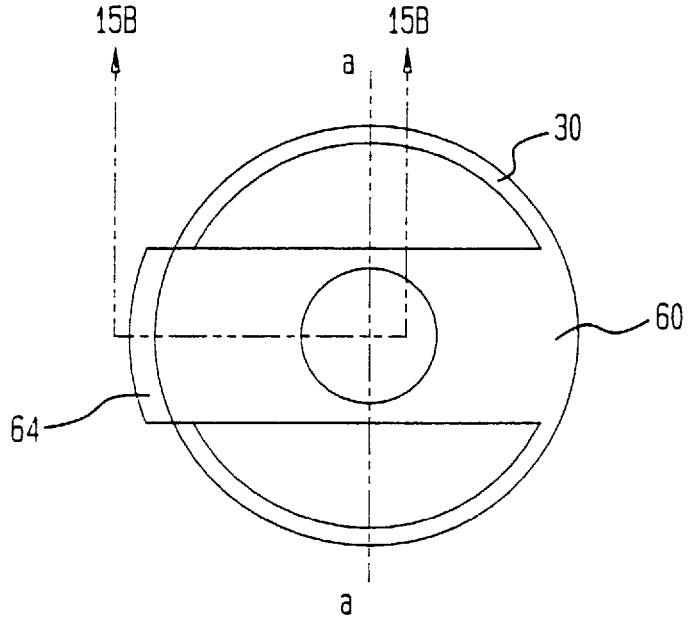
FIG. 15A is a top view of a cap with both a collar and a pull tab.
Figure 15B:
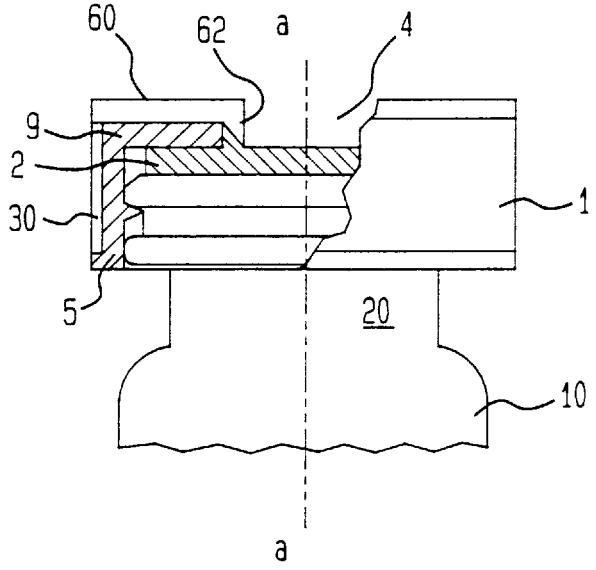
FIG. 15B is side view, in partial cross-section, of a cap-container combination with a cap pull tab in accordance with the present invention, taken along plane 15B—15B of FIG. 15A.

Pull tab 60 on cap 1, described above with reference to FIGS. 13A–14C for a cap-container combination 20 without a collar 30, can also be applied to a cap-container combination 20 with a collar 30—as shown in FIGS. 15A and 15B. Collar 30 is preferably made of a relatively rigid material, such as polypropylene, enabling collar 30 to apply circumferential pressure against the softer and more resilient material of cap 1 (which is, for example, low density polyethylene). Pull tab 60 may be molded integrally with collar 30. Thus, pull tab 60 may be of the same material as collar 30.

Collar 30 can be removed from cap 1 by pushing upward on outer rim 64 of pull tab 60, until locking ring 62 disengages opening 4, and then pulling upward on pull tab 60 until collar 30 is removed from cap 1. Because cap 1 is typically formed of a resilient material when used with collar 30, slight upward pressure against cap 1 will enable the user to remove cap 1 from container 10 once collar 30 is removed from cap 1.

Collar 30 may also be provided with tear grooves 66 defining a tear ring 68, as described above. Tear grooves 66 and tear ring 68 allow the user to break collar 30 upon exerting downward pressure on pull tab 60. Note that, as described above, collar 30 (with or without pull tab 60) may be preassembled with cap 1 or added later.

Figure 16:
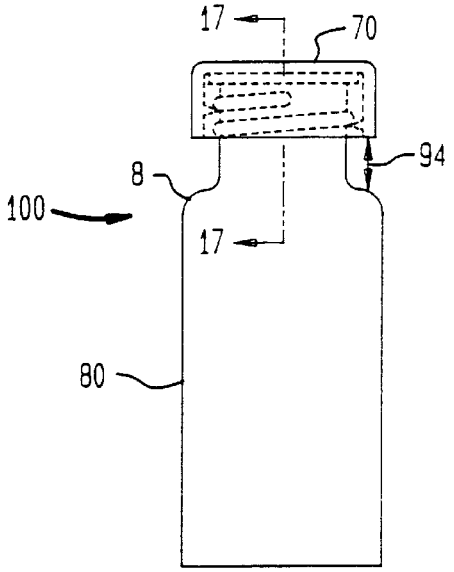
FIG. 16 illustrates a second embodiment of a container and cap combination in accordance with the present invention.
Figure 17:
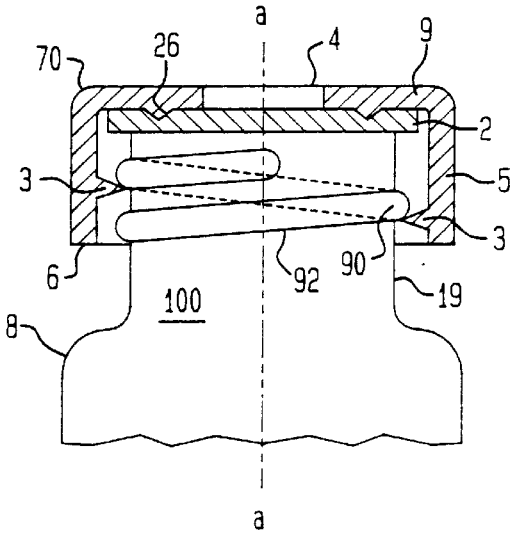
FIG. 17 is an expanded, cross-sectional view of the upper part of the cap-container combination shown in FIG. 16, taken along plane 17—17.
Figure 18:
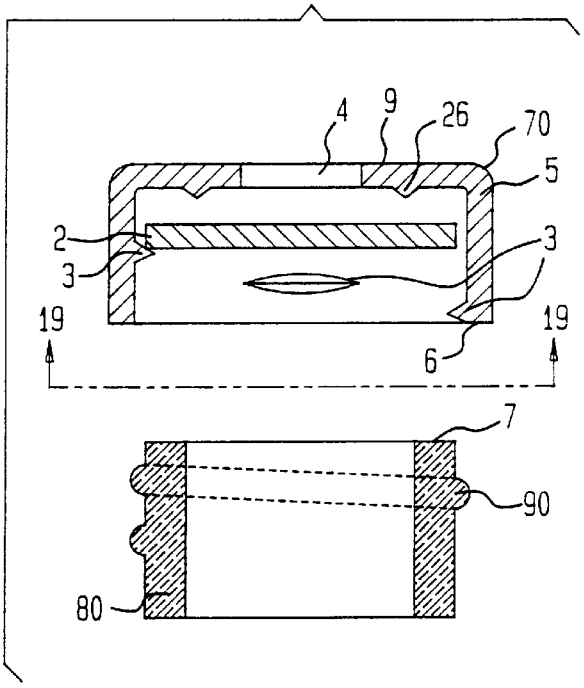
FIG. 18 is similar to FIG. 17 with the components dissembled.

As stated above, one object of the present invention is to alleviate the requirement that suppliers maintain large inventories of several types of caps and several types of corresponding containers. One type of container is illustrated, for example, in FIGS. 2 and 3. The neck finish of that container 10 has an upper flange 11 and a lower flange 12, between which is disposed a snap groove 13. Another type of container 80 is illustrated in FIGS. 16–18. The container 80 shown in FIGS. 16–18 has a standard screw thread neck finish 90. The threads of neck finish 90 form a clockwise helix around container 80.

An alternative embodiment to cap 1 is provided, namely cap 70 as shown in FIGS. 16–19, to sealingly engage screw thread neck finish 90 of container 80 and to form an alternative container and cap combination 100. Because most of the elements of cap 70 and container 80 which form container and cap combination 100 are identical to the elements of cap 1 and container 10 which form container and cap combination 20, like reference numerals have been used to designate like elements throughout the figures.

Cap 70, like cap 1, has a cap skirt 5, the internal diameter of which corresponds to or is only slightly greater than the outer diameter of the screw thread neck finish 90 of container 80. Cap skirt 5 extends vertically (axially) downward from cap top member 9 to cap lower end 6, to be substantially flush laterally with the bottom of the lowest thread 92 of container 80, and facilitates alignment of cap 70 and container 80 as they are assembled.

A number of angular locking ribs 3 project from skirt 5 and are located at circumferentially spaced locations around the inside of skirt 5. Preferably four locking ribs 3 are provided, equidistant from each other, so that they are separated by ninety degrees. Locking ribs 3 are each placed at a different axial height inside skirt 5 to provide a helix around cap 70. The circumferential and axial placement of locking ribs 3 are selected so that locking ribs 3 align with the pitch and angle of screw thread neck finish 90 of container 80 when cap 70 and container 80 are secured.

As shown in FIGS. 16 and 17, a small separation may exist between skirt 5 of cap 70 and the outer diameter of the screw thread neck finish 90 of container 80. Despite such separation, however, the angular shape of locking ribs 3 allows locking ribs 3 to engage the threads of screw thread neck finish 90. Preferably, no separation exists between skirt 5 of cap 70 and the outer diameter of the screw thread neck finish 90 of container 80.

Absent separation, the area of skirt 5 surrounding at least two of locking ribs 3 will define three contact points or lines facilitating alignment between cap 70 and container 80. Each of those locking ribs 3 engage the groove formed by the threads of screw thread neck finish 90 of container 80, thus defining a first line of contact formed between the apex of locking rib 3 and the inner surface of the thread groove. The inner diameter of skirt 5 above and below locking rib 3 contacts the outer diameter of adjacent threads of screw thread neck finish 90, thus defining two additional lines of contact. The three lines of contact self-align and securely retain cap 70 and container 80.

Figure 19:
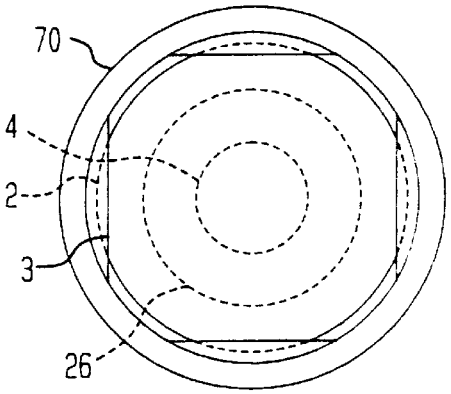
FIG. 19 is a top view of the inside of the cap of the combination shown in FIG. 16, taken along plane 19—19 of FIG. 18.

Locking ribs 3 thus provide the lock mechanism which seals container 80. Circular ridge 26 extends from the underside of top member 9 of cap 70 and aligns with the neck of container 80. Circular ridge 26 applies a slight pressure to liner 2, urging liner 2 outward and, therefore, more securely sealing container 80. Locking ribs 3, as shown in FIG. 19, retain liner 2 thereby preventing liner 2 from falling out of cap 70 and eliminating the need for adhesive, welds, or the like to affix liner 2 inside cap 70.

Cap 70 and container 80 may be secured using a snap on force, a twisting action, or a combination of both. When cap 70 is mounted on container 80 and twisted with a clockwise rotational action, locking ribs 3 parallel the action of a conventional cap thread and travel downward along the helical ramp defined by screw thread neck finish 90. Cap 70 is twisted until it fully engages container 80, as shown in FIG. 17.

Alternatively, when cap 70 is mounted on container 80 and force is applied to top member 9, locking ribs 3 expand past the threads of screw thread neck finish 90 and engage the grooves formed between the threads. Once cap 70 has been locked onto container 80, a slight clockwise rotation of cap 70 will finally and most securely seal cap 70 on container 80. A collar 30, as shown in FIGS. 7–12, may be used in conjunction with cap 70 to further improve the seal between cap 70 and container 80.

Thus, regardless of whether a snap oil force, a twisting action, or a combination of both are used, the thread grooves provide the pull down and lock mechanism in conjunction with locking ribs 3 which seals container 80. Ridge 26 also acts as a fulcrum, when ribs 3 are locked in the grooves between the threads, pulling downward on cap skirt 5.

A reverse of the snap on force, twisting action, or combination of both used to mount cap and container combination 100 will remove cap 70 from container 80. Specifically, cap 70 may be twisted in a counter-clockwise direction. Locking ribs 3 will then parallel the action of a conventional cap thread and travel upward along the helical ramp defined by screw thread neck finish 90. Cap 70 is twisted until it fully disengages container 80. Alternatively, the user may push upward (using, for example, the thumb) on cap lower end 6 with sufficient force to disengage locking ribs 3 from screw thread neck finish 90. To facilitate removal of cap 70 from container 80 by the user, a pull tab 60 may be provided (as shown in FIGS. 13A–15B). Pull tab 60 on cap 70 can also be applied to a cap-container combination 100 with a collar 30.

Cap-container combination 100 offers a unique functional advantage when compared to the conventional combination of a threaded cap and a corresponding threaded container neck finish. The user may inadvertently overtighten or overtorque the conventional device by rotating the cap even after the cap is fully sealed onto the container. Distortion of the liner inserted between the cap and container may result. Consequently, the risk of sample leakage increases. The user may also strip the threads on the cap, the container, or both when the conventional device is overtorqued.

In contrast, cap-container combination 100 eliminates the possibility that the user may inadvertently overtighten or overtorque cap 70 when placing it on container 80. If the user continues to twist cap 70 in a clockwise direction after cap 70 is fully sealed onto container 80, cap 70 will simply disengage screw thread neck finish 90 of container 80. Specifically, at least one flexible locking rib 3 will pop out of engagement with the groove defined by the screw thread. That action (1) informs the user that overtorquing has occurred, (2) prevents distortion of liner 2 and the consequent risk of sample leakage, (3) assures that the threads of screw thread neck finish 90 are not stripped, and (4) maintains the integrity of locking ribs 3. The user can then remove cap 70 and reseat it onto container 80, taking care not to overtighten cap 70 again.

It is preferable to form screw thread neck finish 90 as tightly as possible, wherein the helix requires a minimum axial distance, and to locate screw thread neck finish 90 as close to the top of container 80 as possible. The formation of a tight helix will increase the line of contact between locking ribs 3 and the threads of screw thread neck finish 90. Consequently, a better seal of cap and container combination 100 is achieved. By locating screw thread neck finish 90 close to the top of container 80, a maximum vertical clearance 94 (see FIG. 16) is achieved between lower end 6 of cap 70 and shoulder 8 of container 80. That clearance allows a point of contact 19, as seen in FIG. 17, for positioning container 80, either manually or by automated equipment (such as robotically).

Locking ribs 3 allow cap 70 to be molded in an inexpensive manner. Specifically, during the manufacturing process, cap 70 is simply stripped off the mold core using a stripper plate or sleeve. This avoids the need for a rotating core in which drive gears, bearings, ratchets, and a motor are used to unscrew the molded cap of conventional design. Because the locking ribs 3 are interrupted (and do not traverse the entire circumference of cap 70), the cap can be expanded during stripping. This allows locking ribs 3 to be formed having a clean definition, especially for cap-container combinations 100 with small diameters.

The multiple, circumferentially and axially displaced alignment features of the cap and container combination 100 of the present invention provide a self alignment, which in turn results in better, i.e. more secure, cap retention, as well as more secure seating and sealing of liner 2 between the mating opposing surfaces of cap 70 and the neck finish of container 80. To best accomplish this, the dimensional tolerances of the opposing surfaces of the inner diameters of skirt 5 and the outer diameters of the screw thread neck finish 90 are all tightly controlled, preferably to plus or minus 5–10 thousandths of an inch, most preferably 3–7 thousandths of an inch.

Cap and container combination 100 provides a secure closure which resists sample evaporation losses. The snap on feature of cap 70 avoids the tedious assembly process, of twisting a threaded cap onto a threaded vial such as container 80, yet provides the tight seal achieved by threaded caps. Those users who are most comfortable with threaded closures, however, can twist cap 70 onto container 80—regardless of whether they use the snap on feature of cap 70. Cap 70 can be removed easily from container 80 to add or remove sample.

Figure 20:
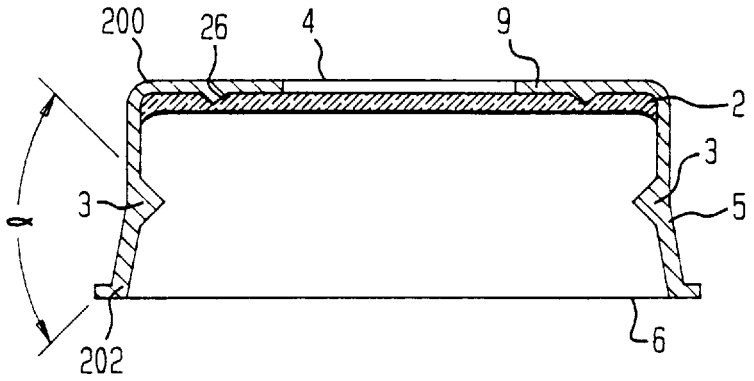
FIG. 20 is an expanded cross-sectional view of the crimp top seal, in accordance with another embodiment of the present invention, before assembly.

The advantageous properties of the resilient snap cap 1 (shown in FIGS. 1 and 2) and the aluminum crimp seal 53 (shown in FIGS. 5 and 6) can be combined in a crimp top seal 200. A first embodiment of crimp top seal 200 of the present invention is illustrated in FIG. 20. A resilient material such as plastic is suitable for manufacturing crimped top seal 200.

Crimp top seal 200 includes top member 9 with a center opening 4 and a circular ridge 26. A skirt 5 extends vertically (axially) downward from top member 9 to the lower end 6 of crimp top seal 200. Four angular locking ribs 3 project from skirt 5 and are located at circumferentially spaced locations around the inside of skirt 5. The angular shape of locking ribs 3 (formed at an angle, Á, of about 120°) allows for tolerance variation of liner 2. Locking ribs 3 retain liner 2 and provide the pull down and lock mechanism which seals the container to which crimp top seal 200 is secured. In addition, locking ribs 3 provide a tactile "feel" and an audible "click" indicating that crimp top seal 200 is secured to the container.

Figure 23:
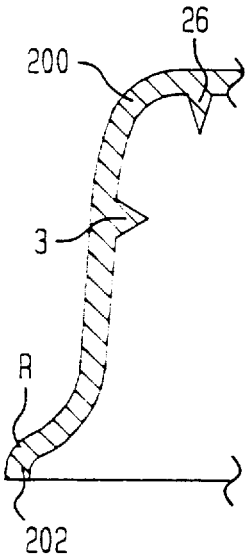
FIG. 23 is an expanded cross-sectional view of the crimp top seal of FIG. 20 with an alternative crimp ring design.

At lower end 6, crimp top seal 200 has a crimp ring 202. Crimp ring 202 extends radially away from skirt 5 and provides the additional material necessary to permit crimp top seal 200 to be crimp around the flange or shoulder of the container to which crimp top seal 200 is secured (see FIG. 21). Crimp ring 202 may extend perpendicularly away from skirt 5, forming a rectangular shape, as shown in FIG. 20. Alternatively, crimp ring 202 may be provided with a radius, R, as shown in FIG. 23. The radius is advantageous because it relieves stress points which otherwise tend to form in crimp top seal 200 during the crimping and removal operations.

Unlike snap cap 1, which is preferably made of low density polyethylene, crimp top seal 200 is preferably made of polypropylene. Polypropylene allows crimp top seal 200 to form and hold its crimped seal better than the less rigid polyethylene material. Also unlike snap cap 1, which has a skirt 5 having (except for ribs 3) a substantially constant internal diameter, skirt 5 of crimp top seal 200 may be provided with a variable internal diameter. Specifically, the internal diameter of skirt 5 above ribs 3 is less than that of skirt 5 below ribs 3. This diametric variation enables crimp top seal 200 to better follow the shape of the flange or shoulder of the container to which it is affixed during the crimping operation.

Figure 21:
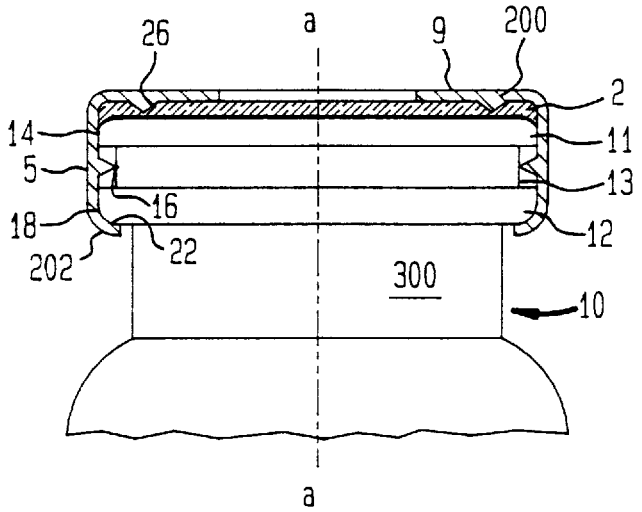
FIG. 21 is an expanded cross-sectional view of the crimp top seal of FIG. 20 shown as applied to the upper part of the container of the present invention.
Figure 22:
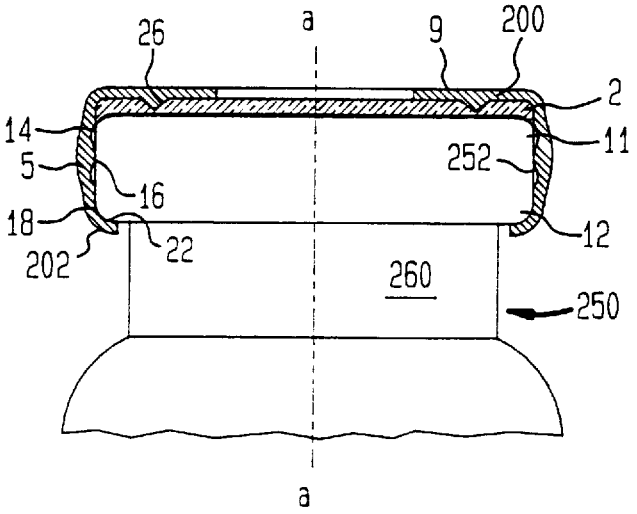
FIG. 22 is an expanded cross-sectional view of the crimp top seal of FIG. 20 shown as applied to the upper part of a standard container.

As shown in FIGS. 21 and 22, crimp top seal 200 allows the user to maintain in inventory a single crimp top seal 200 suitable for at least two separate containers. Consequently, the required cap inventory is minimized. One type of container is illustrated, for example, in FIGS. 2, 3, and 21. The neck finish of that container 10 has an upper flange 11 and a lower flange 12, between which is disposed a snap groove 13. Another type of container 250 is illustrated in FIG. 22. The container 250 shown in FIG. 22 has a standard neck finish 252. Neck finish 252 has an upper flange 11 and a lower flange 12, between which is disposed a straight (vertical) side wall devoid of either threads or a snap groove.

Turning first to FIG. 21, the present invention includes a container and crimp top seal combination 300, comprising container 10 and resilient crimp top seal 200 having an axis, a. Four lines of contact 14, 16, 18, and 22 exist between crimp top seal 200 and container 10 which provide self-aligning and secure retention of crimp top seal 200 and container 10. Crimp top seal 200 is used to seal container 10 by securing crimp ring 202 of skirt 5, as shown in FIG. 21, under lower flange 12 of container 10.

Skirt 5 of crimp top seal 200 provides two lines of contact, 14 and 18, between skirt 5 and upper flange 11 and lower flange 12 of container 10. In addition, there is a line of contact 16 between ribs 3 of skirt 5 and snap groove 13 of container 10. Finally, lower end 6 of skirt 5 forms a line of contact 22 with the bottom of lower flange 12. For some applications, three lines of contact (14, 16, and 18) provide a sufficient seal and crimp top seal 200 need not be crimped to form fourth line of contact 22.

When crimp top seal 200 is mounted on container 10 and force is applied to top member 9, locking ribs 3 expand past upper flange 11 and engage snap groove 13. Thus, snap groove 13 provides the pull down and lock mechanism in conjunction with locking ribs 3 which seals container 10. Ridge 26 also acts as a fulcrum, when ribs 3 are locked in snap groove 13 between upper flange 11 and lower flange 12, pulling downward on skirt 5.

Turning now to FIG. 22, the present invention includes a container and crimp top seal combination 260, comprising standard container 250 and resilient crimp top seal 200 having an axis, a. Four lines of contact 14, 16, 18, and 22 exist between crimp top seal 200 and container 250 which provide self-aligning and secure retention of crimp top seal 200 and container 250. Crimp top seal 200 is used to seal container 250 by securing crimp ring 202 of skirt 5, as shown in FIG. 22, under lower flange 12 of container 250.

Skirt 5 of crimp top seal 200 provides two lines of contact, 14 and 18, between skirt 5 and upper flange 11 and lower flange 12 of container 250. In addition, there is a line of contact 16 between ribs 3 of skirt 5 and the vertical wall of container 250 disposed between flanges 11 and 12. Finally, lower end 6 of skirt 5 forms a line of contact 22 with the bottom of lower flange 12.

When crimp top seal 200 is mounted on container 250 and force is applied to top member 9, locking ribs 3 expand past upper flange 11 and engage the vertical wall of container 250 disposed between flanges 11 and 12. The angle, Á, of about 120° and the inside diameter of crimp top seal 200 are predetermined to assure that ribs 3 "snap" into position approximately in the middle of the vertical wall. Thus, the user receives a tactile "feel" assuring that crimp top seal 200 is correctly aligned and in position before the crimping operation.

The angle of ribs 3 and the inside diameter of skirt 5 of crimp top seal 200 are both critical, in combination, to permit crimp top seal 200 to seal a variety of container types (e.g., both container 10 and container 250). In comparison to snap cap 1 (see FIGS. 2 and 3), ribs 3 of crimp top seal 200 have a more gradual angle—ribs 3 of snap cap 1 have an angle of about 90°—and the inside diameter of skirt 5 of crimp top seal 200 is less than that of snap cap 1. A crimp top seal 200 having the dimensions of snap cap 1 would not seal container 250. The sharper angle of ribs 3 and the greater inside diameter of skirt 5 of snap cap 1 prevent such a crimp top seal 200—at least absent extreme force—from seating on the middle of the vertical wall of container 250. Instead, after the user removes the downward force, ribs 3 push skirt 5 upward. Lower end 6 of skirt 5 then is no longer adjacent the bottom of lower flange 12 of container 250 and the crimping operation cannot be performed.

Two, separate tools are used to apply and to remove aluminum crimp seal 53 (FIGS. 5 and 6) from a container. Both tools are made of metal to provide the force required to apply and remove the relatively rigid aluminum crimp seal 53. During the removal process, the tool literally tears aluminum crimp seal 53 away from the container—creating jagged aluminum edges which pose a danger to the user and equipment. Sharp pieces of aluminum often stick to the jaws of the tool and must be removed. Occasionally, the neck finish on the container breaks—leaving ragged edges which are especially dangerous when the container is glass.

Unlike metal crimp seal 53, it is possible to apply and remove crimp top seal 200 without any tools. If desired, the tools used to apply and remove crimp top seal 200 can be made of relatively inexpensive plastic, rather than metal, because less force is required to apply and remove the plastic crimp top seal 200 than the metal crimp seal 53. During the removal process, the tool pries flexible crimp top seal 200 away from the container without tearing. Avoided are the dangerous, ragged edges of metal crimp seal 53, a broken container neck finish, or both. Even if plastic crimp top seal 200 were to tear during removal, the ragged plastic edges would pose less risk of injury than their metal counterparts.

Figure 24:
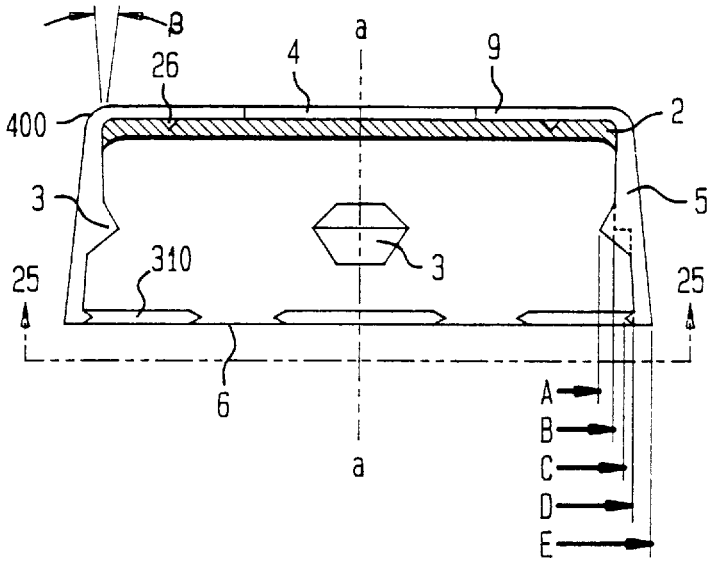
FIG. 24 is an expanded cross-sectional view of an alternative crimp top seal, in accordance with still another embodiment of the present invention, before assembly.
Figure 25:
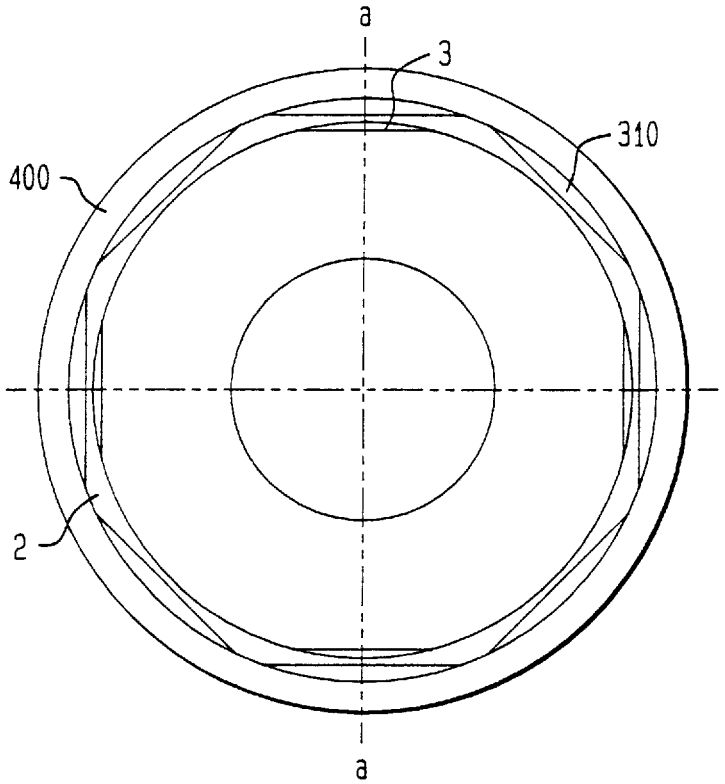
FIG. 25 is a top view of the inside of the crimp top seal shown in FIG. 24, taken along plane 25—25 of FIG. 24.

An alternative embodiment of the crimp top seal is illustrated in FIGS. 24 and 25. FIG. 24 is an expanded cross-sectional view of alternative crimp top seal 400 before assembly. FIG. 25 is a top view of the inside of crimp top seal 400 shown in FIG. 24, taken along plane 25—25 of FIG. 24.

Alternative crimp top seal 400 includes top member 9 with a center opening 4 and a circular ridge 26. A skirt 5 extends vertically (axially) downward from top member 9 to the lower end 6 of alternative crimp top seal 400. Four angular locking ribs 3 project from skirt 5 and are located at circumferentially spaced locations around the inside of skirt 5. The angular shape of locking ribs 3 is very important to assure a tight seal with container 10. As shown in FIG. 24, locking ribs 3 form an angle, $\beta$, of about 12° from vertical. The angular shape of locking ribs 3 also allows for tolerance variation of liner 2 (as discussed more fully below). Locking ribs 3 retain liner 2 and provide the pull down and lock mechanism which seals the container to which alternative crimp top seal 400 is secured.

Clearly, alternative crimp top seal 400 differs from crimp top seal 200 with respect to the angle of locking ribs 3. Alternative crimp top seal 400 also differs from crimp top seal 200 at lower end 6. Although crimp top seal 200 has a crimp ring 202, alternative crimp top seal 400 has a number of lugs 310 positioned at lower end 6 and extending radially inward from skirt 5. Preferably, lugs 310 are equally spaced around the circumference of alternative crimp top seal 400. As shown in FIG. 25, eight lugs 310 spaced at 45° intervals with a depth of about 0.008 inches are suitable. Lugs 310 provide the additional material necessary to permit alternative crimp top seal 400 to be crimped around the flange or shoulder of the container to which alternative crimp top seal 400 is secured (see FIG. 26).

Like crimp top seal 200, alternative crimp top seal 400 is preferably made of polypropylene. Also like crimp top seal 200, skirt 5 of alternative crimp top seal 400 may be provided with a variable internal diameter. Specifically, for the exemplary alternative crimp top seal 400 illustrated in FIG. 24, the internal diameter, B, of skirt 5 above ribs 3 is about 0.425 inches. (The internal diameter, A, of ribs 3 is about 0.409 inches.) The internal diameter, D, of skirt 5 below ribs 3 is about 0.446 inches—somewhat greater than that of skirt 5 above ribs 3. This diametric variation enables alternative crimp top seal 400 to better follow the shape of the flange or shoulder of the container to which it is affixed during the crimping operation. The internal diameter, C, of lugs 310 is about 0.430 inches. Finally, the external diameter, E, of skirt 5 at lower end 6 is about 0.485 inches.

Alternative crimp top seal 400 allows the user to maintain in inventory a single alternative crimp top seal 400 suitable for a variety of separate containers. Consequently, the required cap inventory is minimized. Alternative crimp top seal 400 is especially adapted, however, for use with the unique container 350 illustrated in FIGS. 26 and 27. The neck finish of container 350 has an upper flange 11 and a lower flange 12, between which is disposed a shallow ramp 340. Ramp 340 has an inwardly slanted top 342 and an outwardly slanted bottom 344 which mate with the correspondingly angled sides of ribs 3 of alternative crimp top seal 400 to seal alternative crimp top seal and container combination 360.

Figure 26:
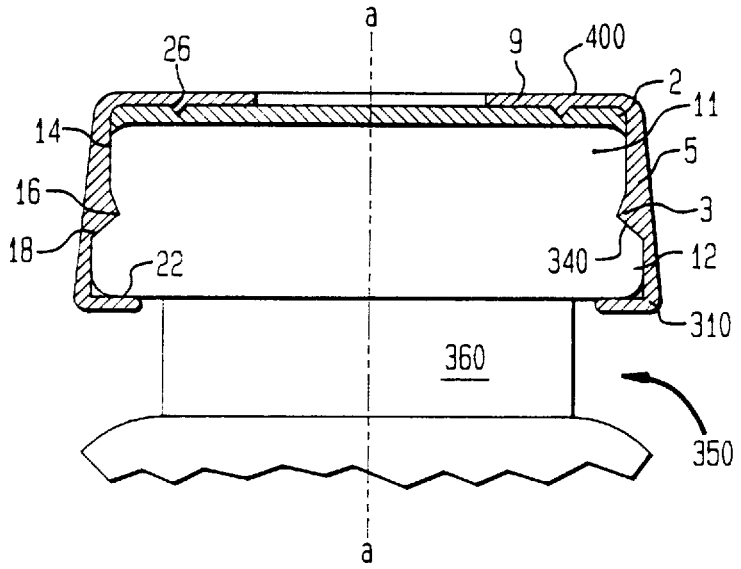
FIG. 26 is an expanded cross-sectional view of the crimp top seal of FIG. 24 shown as applied to the upper part of the container of the present invention.
Figure 27:
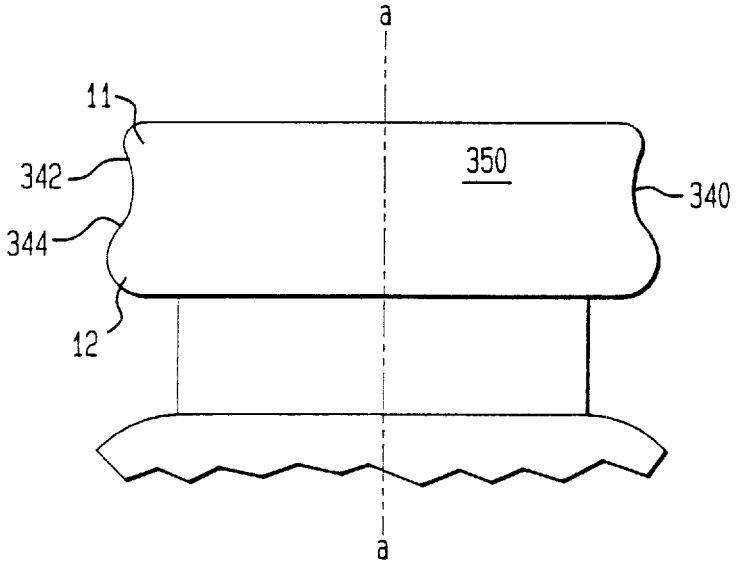
FIG. 27 illustrates a container in accordance with the present invention.

Turning to FIG. 26, the present invention includes alternative crimp top seal and container combination 360 comprising container 350 and alternative crimp top seal 400 having an axis, a. Four lines of contact 14, 16, 18, and 22 exist between alternative crimp top seal 400 and container 350 which provide self-aligning and secure retention of alternative crimp top seal 400 and container 350. Alternative crimp top seal 400 is used to seal container 350 by securing lugs 310 of skirt 5, as shown in FIG. 26, under lower flange 12 of container 350.

Skirt 5 of alternative crimp top seal 400 provides two lines of contact, 14 and 18, between skirt 5 and upper flange 11 and lower flange 12 of container 350. In addition, there is a line of contact 16 between ribs 3 of skirt 5 and ramp 340 of container 350. Finally, lower end 6 of skirt 5 forms a line of contact 22 with the bottom of lower flange 12. For some applications, three lines of contact (14, 16, and 18) provide a sufficient seal and alternative crimp top seal 400 need riot be crimped to form fourth line of contact 22. For other applications, three different lines of contact (14, 16, and 22) provide a sufficient seal and ribs 3 need not seat in perfect alignment with ramp 340.

When alternative crimp top seal 400 is mounted on container 350 and force is applied to top member 9, locking ribs 3 expand past upper flange 11 and engage ramp 340. Thus, ramp 340 provides the pull down and lock mechanism in conjunction with locking ribs 3 which seals container 350. Ridge 26 also acts as a fulcrum, when ribs 3 are locked in ramp 340 between upper flange 11 and lower flange 12, pulling downward on skirt 5.

The "head" pressure, or downward force that the user must apply to top member 9 to mount alternative crimp top seal 400 on container 350 is advantageously small. Tests were done comparing the head pressure for a number of different cap (or crimp top seal) and container combinations. Specifically, four tests were repeated for the following caps and crimp top seal, each in combination with a container 10 having an outer diameter of about 0.425 inches: (1) a low density polyethylene cap 1, (2) a polypropylene cap 1, and (3) a polypropylene alternative crimp top seal 400. Tests were also run for the combinations of (4) a polypropylene alternative crimp top seal 400 and a container 250 having an outer diameter of about 0.425 inches, and (5) a polypropylene alternative crimp top seal 400 and a container 350 also having an outer diameter of about 0.425 inches. The test results are summarized on the following page.

| CONTAINER 10 | | | CONTAINER 250 | CONTAINER |
|---|---|---|---|---|
| LDPE CAP | PP CAP | SEAL | SEAL | 350 SEAL |
| 5.5 | 14.0 | 4.5 | 5.0 | 4.0 |
| 6.25 | 14.5 | 5.0 | 5.5 | 4.5 |
| 5.75 | 16.5 | 5.0 | 5.0 | 4.75 |
| 6.25 | 14.5 | 5.0 | 5.5 | 4.0 |

(All forces in pounds.)

The angle of ribs 3 and the inside diameter of skirt 5 of alternative crimp top seal 400 are both critical, in combination, to permit alternative crimp top seal 400 to seal a variety of container types (e.g., container 10, container 250, and container 350). In comparison to crimp top seal 200, ribs 3 of alternative crimp top seal 400 have a more gradual angle. In addition, alternative crimp top seal 400 replaces crimp ring 202 of crimp top seal 200 with lugs 310 at lower end 6. This replacement provides an advantage.

The crimping tool used to apply and remove a crimp seal, such as either crimp top seal 200 or alternative crimp top seal 400, has (typically) four jaws that compress or release the crimp seal when the user squeezes or releases the handles of the crimping tool. Some crimping tools leave a space or gap between the jaws even in the fully closed position. Such gaps tend to "catch" crimp ring 202 of crimp top seal 200 upon application of crimp top seal 200 to a container using the crimping tool. Consequently, when the jaws of the crimping tool are released, the crimping tool remains caught on crimp top seal 200 and will not release crimp top seal 200 as desired. This problem does not occur for lugs 310 of alternative crimp top seal 400 because the crimping tool rolls lugs 310 under the shoulder of the container. In contrast, the crimping tool must bend crimp ring 202 under the shoulder of the container.

Alternative crimp top seal and container combination 360 is extremely versatile. A single crimp top seal 400 of specified dimensions may be applied to a variety of containers 350 having different dimensions. Specifically, crimp top seal 400 having the dimensions illustrated in FIG. 24 will seal containers 350 having outer diameters at flanges 11 and 12 of 0.420, 0.425, and 0.430 inches. Thus, only one alternative crimp top seal 400 need be maintained in inventory for use with a number of containers. The versatility of alternative crimp top seal and container combination 360 is important, too, because it can account for manufacturing tolerances. A container 350 designed to have an outer diameter at flanges 11 and 12 of 0.425±0.005 inches, for example, may yield an actual container having an outer diameter at flanges 11 and 12 of between 0.420 and 0.430 inches.

The matching angles between ribs 3 of alternative crimp top seal 400 and ramp 340 of container 350 provide both an enhanced seal and increased flexibility. Typically, a number of caps must be provided to accommodate liners 2 of varying thickness. Liners 2 typically vary between 0.010 and 0.040 inches in thickness. Unless a cap 1 having the proper dimensions is used with a thin liner 2, ribs 3 of cap 1 might move within snap groove 13 of container 10. This movement would permit a cap 1, designed for use with a thicker liner 2, to slide vertically with respect to container 10.

Alternative crimp top seal and container combination 360 permits a single crimp top seal 400 of specified dimensions to be used with liners 2 of varying thicknesses. (In fact, the seal achieved by alternative crimp top seal and container combination 360 allows the user to dispense with any liner 2.) A crimp top seal 400 having dimensions which cause ribs 3 to seat in substantially perfect alignment with ramp 340 of container 350, when a relatively thin liner 2 is used, will also seal container 350 when a relatively thick liner 2 is used. Although ribs 3 may "ride up" slanted top 342 of ramp 340 of container 350 when the thicker liner 2 is used, the seal of alternative crimp top seal and container combination 360 remains satisfactory.

Figure 28:
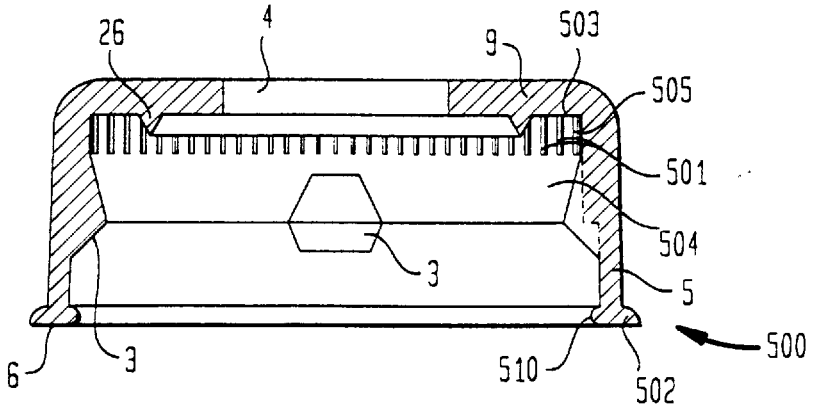
FIG. 28 is an expanded cross-sectional view of an alternative crimp top seal, in accordance with yet another embodiment of the present invention, before assembly.
Figure 29:
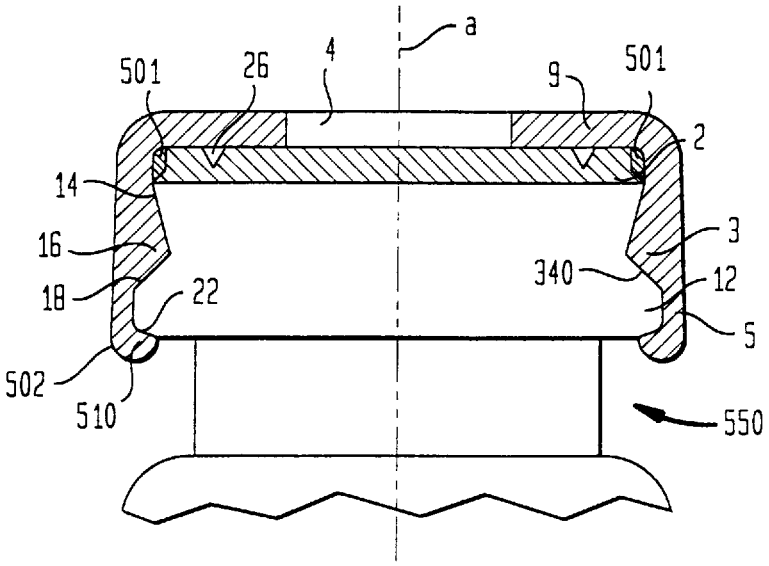
FIG. 29 is an expanded cross-sectional view of the crimp top seal of FIG. 28 shown as applied to the upper part of the container of the present invention.

Another alternative embodiment of the invention is depicted in FIGS. 28 and 29. In this embodiment, the crimp top seal 500 has a skirt 5 of reduced thickness. This prevents the crimping tool from jamming when applying and removing crimp top seal 500. Such jamming may occur with substantially thicker side walls of skirt 5. In the exemplary embodiment shown, the thickness of skirt 5 above ribs 3 is approximately 0.033 inches. Below ribs 3, skirt 5 is approximately 0.026 inches thick.

The reduced thickness of skirt 5 has a disadvantage, however, tending to weaken crimp top seal 500 at the intersection 503 of skirt 5 and top member 9. Accordingly, crimp top seal 500 is provided with a plurality of reinforcing members 501. Reinforcing members 501 strengthen intersection 503. Reinforcing members 501 also serve to help retain liner 2 in position within crimp top seal 500 before attachment to a container.

Reinforcing members 501 in the exemplary embodiment of FIG. 28 are disposed on the inner surface 504 of skirt 5. The tops 505 of reinforcing members 501 abut the underside of top member 9, and reinforcing members 501 extend downward from top member 9 in a direction parallel to the axis of crimp top seal 500. Reinforcing members 501 are approximately 0.030 inches long in the illustrated embodiment.

Reinforcing members 501 may have any suitable cross-sectional shape. In the illustrated embodiment, reinforcing members 501 have a V-shaped cross-section and project radially inward from inner surface 504. The sides of the V typically extend at an angle of 45° from inner surface 504. Reinforcing members 501 may be integrally formed with crimp top seal 500 in a molding process. Accordingly, reinforcing members 501 are typically of the same material as crimp top seal 500.

Crimp top seal 500 also includes a crimp ring 502 with an inner crimp ring surface 510. Crimp ring 502 provides the additional material necessary to bend the lower end 6 of crimp top seal 500 around lower flange 12 of container 550. As crimp ring 502 is bent, inner crimp ring surface 510 contacts the bottom of lower flange 12 as shown in FIG. 29.

Crimp top seal 500 may be applied and removed in the same manner as crimp top seal 400. As with crimp top seal 400, four lines of contact 14, 16, 18, and 22 are formed upon application of crimp top seal 500 to container 550.

Although this invention has been disclosed with reference to specific embodiments, it is apparent that other embodiments and equivalent variations of this invention may be devised by those skilled in the art without departing from the true spirit and scope of this invention. The appended claims are intended to be construed to include all such embodiments and equivalent variations.

What is claimed is:

1. A crimp top seal having a vertical axis and an outer diameter and adapted for combination with a container which has a neck finish including an upper flange, a lower flange with a bottom, and an intermediate area disposed between the upper flange and the lower flange, said crimp top seal formed of plastic and comprising:

(a) a top member having an underside, (b) a dependent skirt, said dependent skirt:

(i) extending axially downward from said top member and having an inner surface and a lower end, (ii) having a first substantially flat surface adapted to engage the upper flange of the container, a second substantially flat surface located axially below said first surface and adapted to engage the lower flange of the container, and a plurality of angular locking ribs located at an axially intermediate position between said first and second surfaces and at circumferentially spaced locations around said skirt and adapted to engage the intermediate area of the neck finish of the container upon downward movement of said crimp top seal onto the container, each of said locking ribs having an angle of about 12 degrees from vertical, and (iii) being sufficiently stiff to effect alignment and sealing engagement with the container by contact above, at, and below said locking ribs; and (c) a plurality of reinforcing members vertically disposed on said inner surface of said skirt and projecting radially inward therefrom, said reinforcing members having tops that abut said underside of said top member.

2. A crimp top seal as claimed in claim 1 further comprising a crimp ring extending radially outward from said skirt at said lower end of said skirt and adapted to be crimped around the lower flange of the container thereby contacting the bottom of the lower flange to further align and seal said crimp top seal on the container.

3. A crimp top seal as claimed in claim 1 wherein said reinforcing members have a V-shaped cross section.

4. A container and crimp top seal combination having a vertical axis and adapted to form a securely sealed closure of said container, said combination comprising:

a container with an upper surface and a neck finish, said neck finish including:

(a) an upper flange, (b) a lower flange having a bottom, (c) an intermediate section disposed between said upper flange and said lower flange, (d) a shoulder disposed beneath said bottom of said lower flange, and (e) a reduced diameter section disposed concentrically with said vertical axis and between said bottom of said lower flange and said shoulder;

a crimp top seal formed of a resilient material and including:

(a) a diameter, (b) a top member having an underside, (c) a dependent skirt having an inner surface adapted to surround said neck finish and to mate therewith, said skirt extending axially downward from said top member and having a lower end, (d) a plurality of flexible locking ribs, each angular in shape to allow tolerance variation and having a top and a bottom, positioned on said inner surface of said skirt at a corresponding plurality of axially intermediate positions and at circumferentially spaced locations around said intermediate section of said neck finish, and (e) a plurality of reinforcing members vertically disposed on said inner surface of said skirt and projecting radially inward therefrom, said reinforcing members having tops that abut said underside of said top member;

a first line of contact between said inner surface of said skirt of said crimp top seal and said neck finish of said container formed by said ribs engaging said intermediate section;

a second line of contact between said inner surface of said skirt of said crimp top seal and said neck finish of said container disposed axially above said first line of contact and formed by said upper flange and said skirt; and a third line of contact between said inner surface of said skirt of said crimp top seal and said neck finish of said container disposed axially below said first line of contact and formed by said lower flange and said skirt, said three lines of contact adapted to align said crimp top seal and said container and to secure a sealing engagement between said underside of said top member of said crimp top seal and said upper surface of said container.

5. The crimp top seal and container combination as recited in claim 4 wherein said crimp top seal further includes a crimp ring extending radially outward from said lower end of said skirt, said crimp ring adapted to be crimped around said lower flange of said container thereby forming a fourth line of contact with said bottom of said lower flange to further align and seal said crimp top seal on said container.

6. The crimp top seal and container combination as recited in claim 5 wherein said reinforcing members have a V-shaped cross-section.

7. The container and cap combination of claim 4 wherein said combination is adapted to form a securely sealed closure of said container via a pull down and lock mechanism.

8. The container and cap combination of claim 4 wherein said intermediate section of said neck finish of said container is a ramp having an inwardly slanted top and an outwardly slanted bottom.

9. A container and cap combination having a vertical axis and adapted to form a securely sealed closure of said container, said combination comprising:

a container with an upper surface and a neck finish, said neck finish having:

(a) a top flange including a top forming said upper surface of said container, (b) an axially displaced lower flange having a bottom, (c) a ramp having an inwardly slanted top and an outwardly slanted bottom and being disposed between said upper flange and said lower flange, (d) a shoulder disposed beneath said bottom of said lower flange, and (e) a reduced diameter section disposed concentrically with said vertical axis and between said bottom of said lower flange and said shoulder; and a cap formed of a resilient material and including:

(a) a diameter, (b) a top member having an underside, (c) a dependent skirt having an inner surface adapted to surround said flanges and said ramp and to mate therewith, said skirt extending axially downward, (d) a plurality of flexible locking ribs, each angular in shape to allow tolerance variation and having a top and a bottom, positioned on said inner surface of said skirt at an axially intermediate position and at circumferentially spaced locations around said ramp of said neck finish, and (e) a plurality of reinforcing members vertically disposed on said inner surface of said skirt and projecting radially inward therefrom, said reinforcing members having tops that abut said underside of said top member;

a first line of contact between said inner surface of said skirt of said cap and said neck finish of said container formed by said ribs engaging said ramp;

a second line of contact between said inner surface of said skirt of said cap and said neck finish of said container disposed axially above said first line of contact and formed by said top flange and said skirt; and a third line of contact between said inner surface of said skirt of said cap and said neck finish of said container disposed axially below said first line of contact and formed by said lower flange and said skirt, said three lines of contact adapted to align said cap and said container and to secure a sealing engagement between said underside of said top member of said cap and said upper surface of said container.

10. The container and cap combination as recited in claim 9 wherein said inwardly slanted top and said outwardly slanted bottom of said ramp each have an angle of about 12 degrees from vertical.

* * * * *